US005565843A

United States Patent [19]

Meyvis

[11] Patent Number: 5,565,843

[45] Date of Patent: Oct. 15, 1996

[54] GARAGE DOOR MESSAGE DISPLAY SYSTEM

[75] Inventor: Daniel V. Meyvis, Bloomfield Hills, Mich.

[73] Assignee: Stanley Home Automation, Novi, Mich.

[21] Appl. No.: 409,592

[22] Filed: Mar. 24, 1995

[51] Int. Cl.[6] ..... G08B 13/08

[52] U.S. Cl. ..... 340/545; 340/330; 340/326; 49/25; 49/31; 49/13; 341/176

[58] Field of Search ..... 340/815.4, 815.6, 340/330, 326, 825.69, 825.72, 545, 932.2, 332; 341/176; 49/25, 31, 13; 116/28 R; 45/451

[56] References Cited

U.S. PATENT DOCUMENTS 4,464,651 8/1984 Duhame ..... 340/521
4,821,024 4/1989 Bayha ..... 340/545
4,835,520 5/1989 Aiello ..... 340/525
4,955,315 9/1990 Lee ..... 116/28 R

*Primary Examiner*—Jeffery Hofsass
*Assistant Examiner*—Julie B. Lieu
*Attorney, Agent, or Firm*—Young & Basile, P.C.

[57] ABSTRACT

A visual display panel is mounted on the exterior surface of a power-operated garage door to display messages for viewing by occupants of a departing automobile after the garage door has closed. The display panel may be part of an integrated home automation system (IHAS) so that, in addition to pre-programmed messages, the operational status of household devices included in the IHAS are presented on the display panel. Actuation of the garage door operator to open the garage door can also cause the IHAS to direct changes in the operation of one or more of the included devices.

16 Claims, 2 Drawing Sheets

10
12
14
15
16
17
18
19
20
22
24
26
28
29
31
33
SECURITY SYSTEM OFF
CLOCK
CALENDER
SWITCH

GARAGE DOOR MESSAGE DISPLAY SYSTEM

FIELD OF THE INVENTION

The present invention relates to a garage door mounted visual display panel for the display of messages to the occupants of an automobile when the garage door is in the closed position. More specifically, the present invention relates to such a garage door display panel operating as part of an integrated home automation system.

BACKGROUND OF THE INVENTION

Home security systems, environment control systems, telephone answering machines, lights and appliances found in the home can be controlled by microprocessor based, programmable control systems. Several commercially available systems provide the capability to connect electrically operated appliances and lights in a house-wide network. Such a network is known as an integrated home automation system (IHAS). These systems provide centralized, programmable control over any and all of the devices making up the network.

One such system is TotalHome, made by Honeywell. A description of this system is given in the May 1992 issue of "Popular Science" magazine on page 48. TotalHome includes a wall-mounted microprocessor-based control unit and provides the ability to control up to ten lights or appliances, ten points of security, and home temperature. In TotalHome and other similar systems, the existing household electrical wiring into which appliances are plugged for power is used to provide electronic communication between those appliances and the control unit. In a system configured in this manner a person may program the control unit to start, stop or otherwise alter the operation of various appliances at the appropriate time throughout a daily, weekly, or monthly schedule. The program may be reviewed and the operational status of any appliance monitored by means of a small visual display located on the control unit.

Electrically powered garage door operators are widely used in American homes and may be remotely actuated, usually by means of a radio frequency transmitter, to open and close a garage door. One such garage door operator is described in U.S. Pat. No. 4,025,809 the disclosure of which is incorporated herein by reference.

Personal computers may be used as planning and scheduling tools, with many companies selling software packages which allow a person to maintain an electronic calendar of upcoming appointments and events. The user can update the computer data base as necessary and thereby reduce the likelihood of forgetting any of these commitments. One practical limitation on the usefulness of a schedule maintained on a computer data base is that in order to be reminded of a scheduled event a user must have access to the computer and consult the data base in some fashion, i.e., must enter commands through a keyboard or the like to call up the information on a personal computer display screen.

An effective time to remind a computerized schedule user of events scheduled for a particular day is before the user departs his/her home at the start of that day. This is also an appropriate time to alert that person to any important information about the status of household systems or devices. Assuming that the person leaves home by way of a garage, the exterior surface of the garage door provides, when in the closed position, an area clearly visible to occupants of a departing vehicle.

SUMMARY OF THE INVENTION

It is an objective of the present invention to provide a system by which messages may be presented to the occupants of a vehicle immediately after it has exited a garage equipped with a power door operator. This is accomplished by mounting a display panel to the garage door so that the panel is visible from a vehicle located outside the garage when the garage door is closed. The display panel is electronically interfaced with message generator means which produces visual displays on the panel. The message generator means may consist of a personal computer, a clock, and/or any other electronic device or combination of devices capable of providing the necessary data and presenting it to the display in usable form. The message generator means is triggered when a garage door operator is actuated to move the garage door from an open position to its closed position so that the display panel is only activated when the door closes, and then only for a programmed length of time.

In a preferred embodiment of the present invention, both the garage door operator and the garage door mounted display panel are components of an integrated home automation system (IHAS). A computer directs operation of the household electrical devices which make up the IHAS and also collects information regarding the status of the devices and transfers it to the display panel for presentation. Any other information stored in the computer, such as scheduled events, may also be presented on the panel.

DETAILED DESCRIPTION OF THE PREFERRED EMBODIMENT

Figure 1:
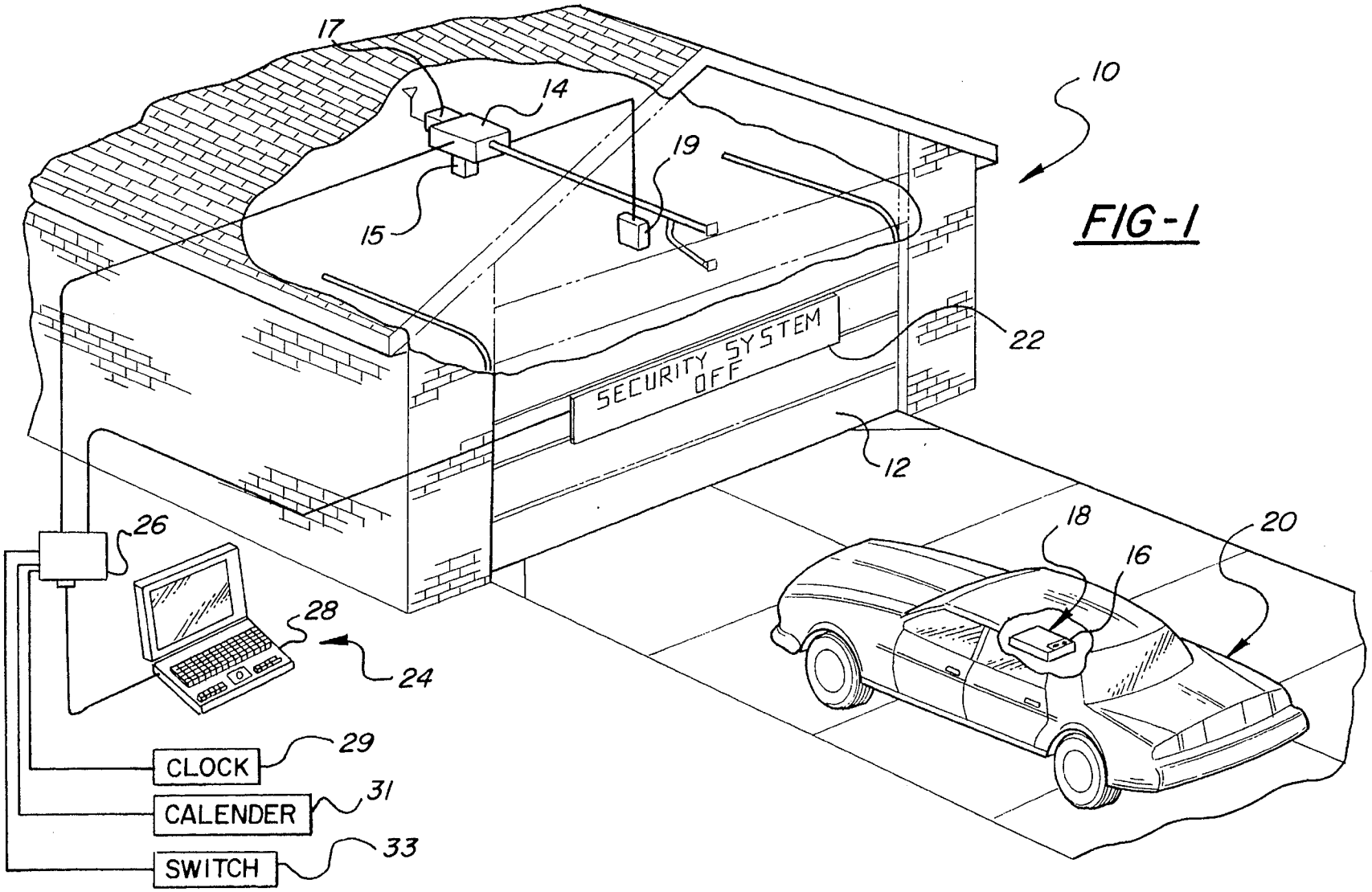
FIG. 1 is a perspective view showing the major components of the first embodiment of the present invention.

FIG. 1 shows a garage 10 with a garage door 12 which is movable between its open and closed positions by a mechanically conventional power-driven garage door operator 14 such as that of U.S. Pat. No. 3,825,809 titled "Garage Door Power Operator Having Partial Open Capability", issued Jul. 23, 1979, the disclosure of which is incorporated herein by reference. Garage door operator 14 may be actuated to open and close garage door 12 by means of a remote control transmitter 18, usually carried in an automobile 20, which emits a radio frequency signal when an open/close button 16 is depressed. A receiver 17 associated with door operator 14 actuates door operator 14 when the signal emitted by transmitter 18 is received. Alternatively, the operator 14 may be actuated by a push button switch 19 which is hard-wired to the operator. The operator 14 may be chain, cable or screw drive or any other suitable design for raising and lowering a garage door on demand.

In accordance with the invention, an electronic display panel 22 is mounted on the exterior surface of garage door 12 in a position so that it may be viewed by occupants of automobile 20 when it is outside of garage 10 and garage door 12 is closed.

Figure 2:
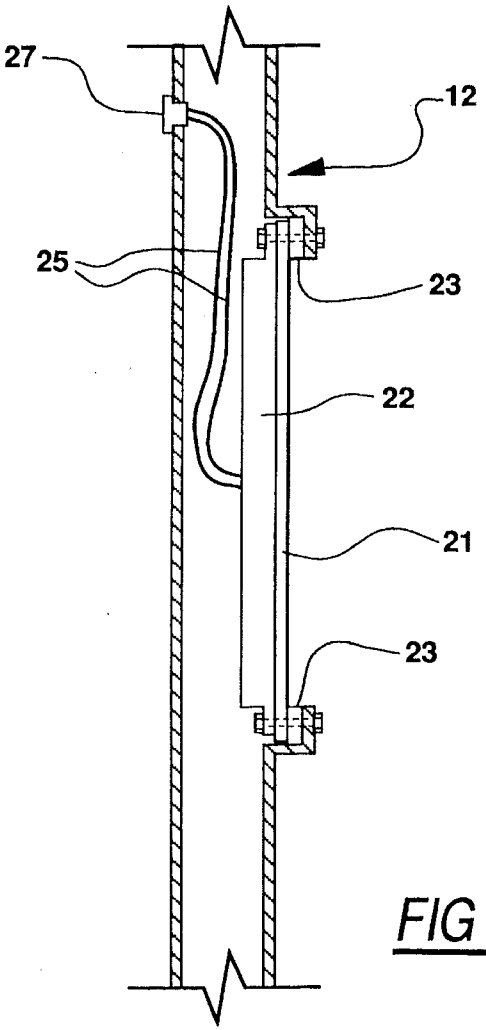
FIG. 2 is a cross sectional view of a garage door having a built-in display panel.

In the preferred embodiment shown in FIG. 2, display panel 22 and garage door 12 are constructed as an integrated unit, with the panel 22 enclosed in the structure of the door and visible through an opening formed in the door's exterior surface. A pane 21 of transparent, impact-resistant plastic or the like covers display panel 22, and gasket 23 surrounds the opening in door 12 to provide a weather-proof seal. Electrical wires 25 associated with panel 22 are routed through the interior of door 12, terminating at a connector 27 located on the interior of door 12. Alternatively, display panel 22 may be constructed as a self contained, weather-sealed unit and attached to the exterior of an existing garage door with screws, adhesive or other suitable fastening means.

Display panel 22 is capable of displaying alphanumeric and other graphic symbols and may be any of the several types of electronically controlled displays commonly used in computer peripheral devices, among these being liquid crystal displays, light emitting diode displays, plasma displays, or flat panel cathode ray displays. The size and brightness of the symbols presented on display panel 22 must be at least sufficient to be readable by occupants of automobile 20 when it is stopped immediately outside of garage 10. Symbology should therefore be a minimum of from 2 to 6 inches high. For some applications, the system owner may wish to be able to read messages on display panel 22 from a greater distance away, such as from the end of a long driveway, and so symbology on the order of up to 12 inches high may be used. Consequently, the optimum type and size of display may vary with different specific applications, but a display of approximately 12 inches high by 36 inches long is adequate for most uses. Note that a display panel 22 of a given size will be capable of presenting either a single line of large text or multiple lines of smaller sized text.

As shown in FIG. 1, display panel 22 and garage door operator 14 are electronically coupled to a microprocessor-based message generator system 24. Message generator system 24 includes a message coordinator 26 which serves as a "driver" for display panel 22, generating the electronic signals necessary to produce visual displays. Message coordinator 26 also provides means to collect and integrate electronic information from several sources including a computer 28, a 24 hour clock 29, a calendar 31, and a condition-control switch 33. In principle, any compatible electronic device may serve as a source of information, switch 33 serving to represent such devices as relays, alarms, door switches, window switches, accessory and appliance power switches and the like.

Actuation of door operator 14 to move garage door 12 from the open position to the closed position triggers message generator 26 to accept information from one or more of the sources and generate an appropriate display on panel 22. The display generated may relate to the condition of switch 33, alerting automobile occupants with messages such as: FRONT DOOR AJAR, ALARM NOT ACTIVE, OVEN ON, etc. Message coordinator 26 may be programmed by the system user to take into account time-of-day and day-of-week inputs from clock 29 and calendar 31. For example, the system user may program message coordinator 26 to only display home alarm status when a departure from home, as indicated by the closing of garage door 12, occurs after 5:00 p.m. on weekdays or all day on weekends. Similarly, the system user may program message coordinator 26 with a message importance hierarchy, instructing the sequence in which multiple messages are to be presented. Message coordinator 26 can arrange multiple messages into a queue in accordance with the hierarchy and step through the queue, causing each one to be presented for user-programmed length of time. Alternatively, message coordinator 24 may be programmed to present multiple messages by scrolling them across the display panel.

In a preferred embodiment of the invention, computer 28 consists of a personal computer such as an IBM PC® or the equivalent, and is programmed to execute any of the several commercially available software packages directed toward personal planning and scheduling, such as the calendar/reminder feature present in Wordperfect for Windows® sold by WordPerfect Corporation. These software packages allow a user to store information in a "calendar" format with the aim of providing reminders of planned events. Whenever door operator 14 is actuated to close garage door 12, messages stored in computer 28 that are appropriate for the particular day and time will be relayed to message coordinator 24 and presented on display panel 22. Examples of the types of messages/reminders that may be useful are: GARBAGE DAY, MORNING MEETING, MOTHER'S BIRTHDAY, LAST DAY OF THE MONTH, PAY GAS BILL, etc.

If there are no pertinent messages to be displayed on panel 22, the current time and date as supplied by clock 29 and calendar 31 may be displayed, or the system user may program a default message such as GOODBYE or SECURITY ALARM SET. If the system user desires, a message such as SECURITY ALARM SET may be displayed at all times the garage door is closed to act as a deterrent to would-be thieves.

As described in the aforementioned U.S. Pat. No. 3,825,809, garage door operator 14 includes a reversible electric motor (not shown) to drive garage door 12 between the open and closed positions and limit switches which shut off the electric motor when garage door 12 has reached its fully open or closed positions. The deenergization of the electric motor by the closed position limit switch 15 acts as a trigger to cause message coordinator 24 to generate appropriate messages for display on panel 22. Alternatively, the energization of the electric motor at the beginning of the downward motion of garage door 12 may serve as the trigger.

Figure 3:
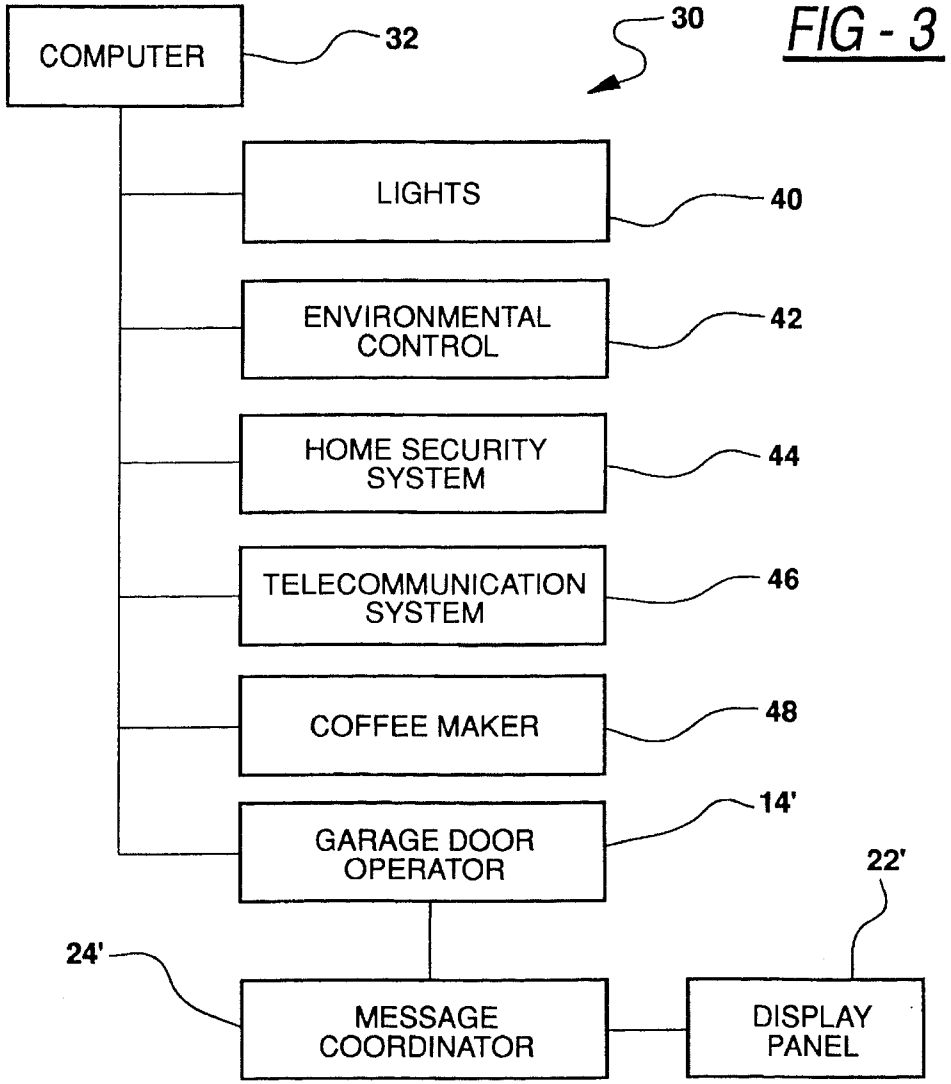
FIG. 3 is a schematic diagram of the second embodiment of the present invention.

In a second embodiment of the present invention, shown schematically in FIG. 3, display panel 22', message coordinator 24', and garage door operator 14' are in operative communication with and form part of a network of household devices which together constitute an integrated home automation system (IHAS) 30. In the IHAS 30 depicted, a central computer 32 is programmed to control the operation of household appliances such as lights 40, an environmental control system 42 which may include heating and air conditioning units, a home security system 44 which may include intruder and fire detection functions, a telecommunications system 46 which may include a telephone answering machine or voice mail system, and individual appliances such as a coffee maker 48. As is well known in the home automation field, an IHAS may be configured to permit electronic communication between computer 32 and the devices included in the network by means of the household electrical wiring from which the devices receive electrical power. This eliminates the need for the addition of special wiring in an existing house in which an IHAS is to be installed.

The IHAS operating program contained in and executed by computer 32 will include instructions controlling the display of messages on panel 22'. A typical set of instructions may be to present information related to the operational status of any of the household devices if such status may indicate an unsafe condition. For example, messages may be presented to alert the departing resident that an electrical appliance such as coffee maker 48 has been left on or that home security system 44 is not functioning properly. These messages give the resident a chance to reenter the house and correct the described condition if he or she so desires.

The basic appliance control functions of computer 32 may be accomplished with a small, microprocessor-based control unit such as is used in the Honeywell TotalHome system described above. In the preferred embodiment, however, computer 32 will be a more capable device, such as an IBM PC®, which is used by the homeowner for many other purposes such as entertainment, financial matters, and business. Thus, the personal planning and scheduling functions performed by computer 28 of the first described embodiment will be included in computer 32 so that display panel 22' may present messages such as reminders of scheduled events as well as those relating to the operational status of household systems.

Having garage door operator 14' connected with IHAS 30 also provides the capability to use the opening of garage door 12 as a trigger for changes in the operational status of one or more household devices making up IHAS 30. For instance, instructions programmed into computer 32 may direct the opening of garage door 12 within a certain programmed time window to cause designated lights 40 to switch on, environmental control system 42 to increase or decrease the home temperature, and/or security system 44 to change modes.

It will be appreciated that the drawings and description contained herein are merely meant to illustrate particular embodiments of the present invention and are not meant to be limitations on the practice thereof, as numerous variations will occur to skilled persons. For example, the message display system may be configured to present messages on the display panel when the garage door operator is actuated to open the door, thereby presenting the occupants of an arriving automobile with information before or as the garage door is opened. Or, in a slight variation on the network shown in FIG. 3, message generator 24' may operatively communicate directly with computer 32 rather than this communication link being routed through garage door operator 14'.

I claim:

1. In combination:

a garage door;

a power-driven door operator mechanically connected to the door and actuable to move the door to open and closed positions;

a message display panel carried by the door and operative to present visual displays of alphanumeric and other graphic symbols visible from the exterior side of the door when the door is in the closed position;

message generator means in operative communication with the panel and activatable for producing the visual displays presented thereon when the door operator is actuated; and means responsive to actuation of the operator to activate the message generator means.

2. The apparatus as defined in claim 1 wherein the message display panel is operative to present the visual displays only after the door operator is actuated to move the garage door to the closed position.

3. The apparatus as defined in claim 1 further comprising a remote door operator control including a radio frequency transmitter and a radio frequency receiver, the receiver being connected to actuate the door operator.

4. The apparatus as defined in claim 1 wherein the message generator means includes a clock.

5. The apparatus as defined in claim 1 wherein the message generator means includes a microprocessor-based computer.

6. The apparatus as defined in claim 5 wherein the computer is operable to maintain a schedule of events and communicate information regarding the schedule to the display panel for presentation thereon.

7. The apparatus as defined in claim 6 wherein the content of the visual display is determined at least in part by the time and date at which the visual display is presented.

8. The apparatus as defined in claim 1 wherein electronic communication between the door operator, the display panel and the message generator means is achieved via a household electrical wiring system from which the door operator, the display panel and the message generator means receive electrical power.

9. The apparatus as defined in claim 1 wherein the door operator, the message display panel, and the message generator means are in operative communication with and form part of an integrated home automation system.

10. The apparatus as defined in claim 9 wherein the visual displays pertain to the operational status of one or more household devices included in the home automation system.

11. The apparatus as defined in claim 9 wherein the integrated home automation system includes a computer for controlling the operational status of one or more household devices, and actuation of the door between the open and closed positions generates a signal communicated to the computer and used by the computer as an input in its control of the operational status of one or more of the household devices included in the home automation system.

12. A garage door message display system for incorporation in an integrated home automation system wherein a computer monitors and controls a plurality of household devices in accordance with programmed instructions, the message display system operable to visually present messages pertaining to the operational status of the household devices and comprising:

a garage door movable between an open and a closed position;

a garage door operator electronically actuable to move the garage door between the open and closed positions, said door operator being in operative communication with the computer to provide the computer with a signal representing door position;

a visual message display panel carried by the door and visible from the exterior side of the door;

message generator means electronically coupled with the computer to receive information pertaining to the operational status of the household devices and with the display panel to produce visual displays thereon, the visual displays being produced from the information received from the computer; and means for actuating the door operator to close the door and activate the display.

13. The garage door message display system as defined in claim 12 wherein movement of the garage door between the open and closed positions triggers the production of the visual displays.

14. The garage door message display system as defined in claim 12 wherein actuation of the door between the open and closed positions generates a signal communicated to the computer, said signal serving as an input to the programmed instructions controlling the operation of one or more of the household devices.

15. The garage door message display system as defined in claim 12 wherein the computer further functions to maintain a schedule of events, information regarding the schedule being communicated to the message generator means for production of visual displays therefrom.

16. The garage door message display system as defined in claim 12 wherein the garage door operator is actuated by means of a remote control system comprising a radio frequency transmitter and a radio frequency receiver, the receiver being connected to the door operator.

* * * * *